US008171851B2

(12) United States Patent
Siddle et al.

(10) Patent No.: US 8,171,851 B2
(45) Date of Patent: May 8, 2012

(54) KINETIC ENERGY PENETRATOR

(75) Inventors: David R. Siddle, Greensburg, PA (US); Christopher D. Dunn, Greensburg, PA (US)

(73) Assignee: Kennametal Inc., Latrobe, PA (US)

( * ) Notice: Subject to any disclaimer, the term of this patent is extended or adjusted under 35 U.S.C. 154(b) by 287 days.

(21) Appl. No.: 12/416,564

(22) Filed: Apr. 1, 2009

(65) Prior Publication Data

US 2010/0251921 A1 Oct. 7, 2010

(51) Int. Cl.
*F42B 12/22* (2006.01)
*F42B 12/72* (2006.01)

(52) U.S. Cl. ..... 102/506; 102/513; 419/17

(58) Field of Classification Search ..... 102/501, 102/506, 517, 293; 419/66, 17, 62; 75/240, 75/236, 239; 977/777
See application file for complete search history.

(56) References Cited

U.S. PATENT DOCUMENTS 5,760,331 A * 6/1998 Lowden et al. ..... 102/506
5,963,776 A * 10/1999 Lowden et al. ..... 419/64
6,010,580 A * 1/2000 Dandliker et al. ..... 148/403
6,149,705 A * 11/2000 Lowden et al. ..... 75/240
6,248,150 B1 * 6/2001 Amick ..... 75/248
6,457,417 B1 * 10/2002 Beal ..... 102/517
6,749,802 B2 * 6/2004 Amick ..... 419/37
6,793,875 B1 9/2004 Shaw et al.
6,799,518 B1 * 10/2004 Williams ..... 102/513
6,845,719 B1 * 1/2005 Spencer ..... 102/519
6,960,319 B1 11/2005 Kapoor
7,261,036 B2 8/2007 Bourne et al.
7,770,521 B2 * 8/2010 Williams et al. ..... 102/364
7,886,666 B2 * 2/2011 Williams et al. ..... 102/302
7,992,500 B2 * 8/2011 Williams ..... 102/513
2006/0048668 A1 * 3/2006 Williams ..... 102/513
2006/0144281 A1 * 7/2006 Williams et al. ..... 102/517
2006/0288897 A1 * 12/2006 Williams et al. ..... 102/364
2009/0301337 A1 * 12/2009 Wilson et al. ..... 102/364
2010/0288151 A1 * 11/2010 Williams et al. ..... 102/364
2011/0100245 A1 * 5/2011 Williams et al. ..... 102/364
2011/0168049 A1 * 7/2011 Williams et al. ..... 102/513

* cited by examiner

*Primary Examiner* — Michael Carone
*Assistant Examiner* — Jonathan C Weber
(74) *Attorney, Agent, or Firm* — Matthew W. Smith

(57) ABSTRACT

A kinetic energy penetrator is provided comprising a consolidated body of a metal nanoparticles phase comprising metal nanoparticles and a metal carbide nanoparticles phase comprising metal carbide nanoparticles. Methods for making a kinetic energy penetrator as well as material compositions comprising a consolidated body of a metal nanoparticles phase comprising metal nanoparticles and a metal carbide nanoparticles phase comprising metal carbide nanoparticles are also provided.

13 Claims, 4 Drawing Sheets

KINETIC ENERGY PENETRATOR

GOVERNMENT CONTRACT

This invention was made with Government support under Agreement No. W911NF-04-2-0037, awarded by ARL. The Government has certain rights in the invention.

FIELD OF THE INVENTION

This invention relates to the field of kinetic energy penetrators and processes of making them, as well as to material compositions comprising a consolidated body of a metal nanoparticles phase comprising metal nanoparticles and a metal carbide nanoparticles phase comprising metal carbide nanoparticles.

BACKGROUND INFORMATION

A kinetic energy penetrator is a type of ammunition which, like a bullet, does not contain explosives and instead uses kinetic energy to penetrate the particular target. A kinetic energy penetrator is typically a high-density object with a high aspect ratio, which penetrates solid bodies by means of its own momentum. Typically, a kinetic energy penetrator is in the form of a rod which may be flat, pointed, or rounded at one end.

The principle of the kinetic energy penetrator is that it uses its kinetic energy, which is a function of mass and velocity, to penetrate armor. Modern kinetic energy penetrators maximize kinetic energy and minimize the area over which it is delivered by being fired with a very high muzzle velocity, concentrating the force in a small impact area while still retaining a relatively large mass, and maximizing the mass of whatever volume is occupied by the projectile by using the densest metals practical.

It is desirable for kinetic energy penetrators to have a large amount of remaining kinetic energy at impact. Remaining kinetic energy is directly proportional to velocity and mass of the penetrator at impact. Depleted uranium-based alloys have conventionally been used in kinetic energy penetrators due to their high-density of approximately 19 grams/cm$^3$ in order to carry the required mass at penetration.

It is also desirable for kinetic energy penetrators to have very little widening of the penetrators' cross section during impact and penetration. The undesirable widening effect is sometimes referred to as "mushrooming." It is believed that a penetrator that has little mushrooming on impact will travel more efficiently into and through the target. Kinetic energy penetrators made of depleted uranium typically have very little mushrooming due to what is believed to be an adiabatic shearing mechanism of the material. Adiabatic shearing promotes a self-sharpening mechanism that provides a longer penetration time in the target than a material without this property.

Despite its desirable performance properties, depleted uranium and its alloys have many significant manufacturing and environmental hazards associated with its use. For example, depleted uranium alloys are costly to fabricate, handle, and store because of their extremely complex metallurgy and the obvious health considerations associated with the use of uranium.

A variety of tungsten heavy alloy based penetrators have been developed as a substitute for depleted uranium. However, these materials require significantly higher initial impact velocity to penetrate a target when compared to depleted uranium. Moreover, materials such as tungsten do not demonstrate adiabatic shearing during impact and penetration but instead demonstrate significant mushrooming. Tungsten carbide-cobalt alloys have also been used in kinetic energy penetrators, however, these materials have comparatively low densities and a relatively high rate of shattering on impact.

Typical powder metallurgy processes using, for example, either depleted uranium or tungsten-based materials, include a step where the powder form is subjected to very high temperatures to allow the powder particles to sinter, either through a solid-state process or, if a secondary binder is present that reaches a liquid state, through liquid phase sintering. Both of these processes enable secondary effects, such as grain growth during the high temperature portions of the process. This grain growth occurs quite rapidly and can mean that the final consolidated material will have a grain structure that is significantly different from the initial grain structure in the powder. In the case of the initial powder state containing grains sized in the nanometer scale, these grain growth mechanisms can be triggered at lower energy levels due to the highly reactive and high surface area nature of these particles. Thus, it has typically been difficult to maintain a nanometer sized particle after sintering.

One method to control grain growth in typical sintering practice is to include additives to the base powder that act as barriers to the grain growth process. An example of this is the addition of tantalum to tungsten carbide-cobalt powders where the tantalum, usually in the form of tantalum carbide, forms on the grain boundaries of the tungsten carbide grains and prevents the overall grain growth mechanism.

Therefore, it would be desirable to have a material for use in a kinetic energy penetrator that approaches the density of depleted uranium so as to have a large amount of remaining kinetic energy at impact, maintains nanometer-scale particles, and undergoes adiabatic shearing so as to exhibit very little mushrooming on impact allowing more efficient penetration into the target.

The present invention has been developed in view of the foregoing.

SUMMARY OF THE INVENTION

In certain aspects, the present invention relates to a kinetic energy penetrator comprising a consolidated body of a metal phase comprising metal nanoparticles and a metal carbide phase comprising metal carbide nanoparticles.

In other aspects, the present invention is directed to a method for making a kinetic energy penetrator comprising a method for making a kinetic energy penetrator comprising: a) providing a mixture of metal nanoparticles and metal carbide nanoparticles; b) consolidating the mixture of the metal nanoparticles and the metal carbide nanoparticles to provide a consolidated body of a metal nanoparticles phase and a metal carbide nanoparticles phase; and c) recovering a shaped penetrator from the consolidated body of the metal nanoparticles phase and the metal carbide nanoparticles phase.

In yet other aspects, the present invention is directed to a material having a specific gravity of at least 17.0 grams/cm$^3$ comprising: a consolidated body of a metal phase comprising metal nanoparticles and a metal carbide phase comprising metal carbide nanoparticles; wherein the metal nanoparticles comprise a metal selected from the group consisting of tungsten, uranium, tantalum, hafnium, rhenium, and combinations thereof and are present from 40 weight percent to 95 weight percent, based on the total combined weight of the metal nanoparticles and the metal carbide nanoparticles; and wherein the metal carbide nanoparticles comprise a metal carbide selected from the group consisting of tungsten carbide, tantalum carbide, iron carbide, niobium carbide, and combinations thereof and are present from 5 weight percent to 60 weight percent, based on the total combined weight of the metal nanoparticles and the metal carbide nanoparticles.

These and other aspects will become more apparent from the following description.

DETAILED DESCRIPTION

Figure 1:
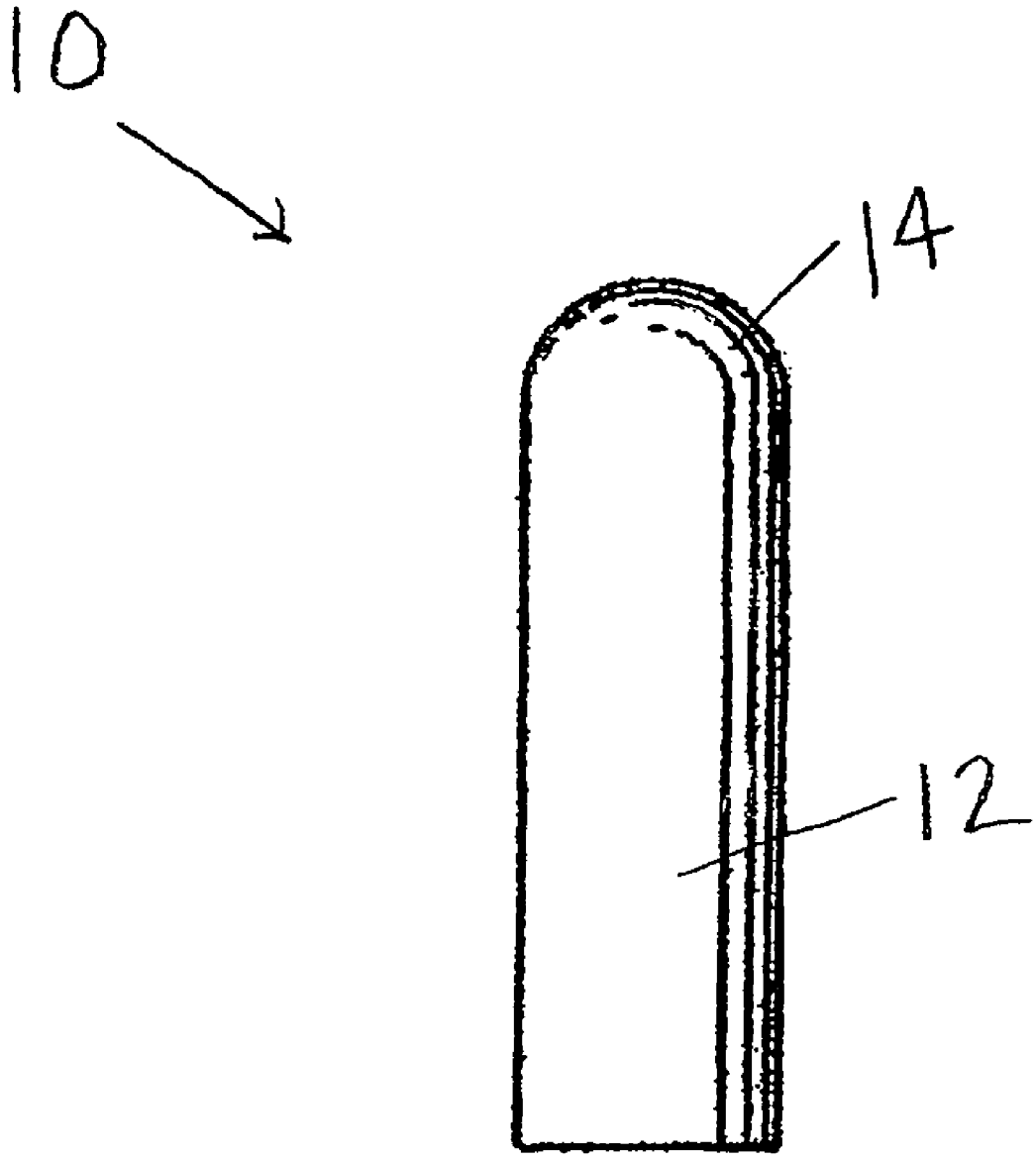
FIG. 1 illustrates an elevation view of an exemplary kinetic energy penetrator that may be made of multiple nanoparticle components in accordance with an embodiment of the present invention.

As shown in the embodiment of FIG. 1, a kinetic energy penetrator 10 may be provided in the form of a cylindrical rod with a generally cylindrically body 12 and a rounded head 14. A typical kinetic energy penetrator has a diameter ranging from 5 mm to 25 mm and a length ranging from 10 mm to 1000 mm, depending on the caliber of the munitions. For example, small caliber ammunition has a diameter ranging from 4 mm to 7 mm and a length ranging from 10 mm to 70 mm; medium caliber ammunition has a diameter ranging from 7 mm to 20 mm and a length ranging from 70 mm to 150 mm; and large caliber ammunition has a diameter ranging from 20 mm to 40 mm and a length from 150 mm to 1000 mm. Although the kinetic energy penetrator 10 shown in FIG. 1 has a rounded head 14, the rod need not have the illustrated shape of a hemisphere blending into a cylinder. A cone, ogive, blunt end, or other known shape may also be suitable. The penetrator may be used as a projectile on its own, in which case it may be launched with a sabot. Penetrators of the present invention may be utilized with a variety of known sabot structures (not shown) including push and pull-type sabots. In a push-type sabot, propellant gases are substantially trapped behind a sealing flange or other protuberance located relatively aft along the projectile and typically aft of an additional flange. In a pull-type sabot, the sealing flange is relatively forward along the projectile and may be ahead of an additional flange or feature which helps maintain the projectile centered within the tube. Alternatively, penetrators of the present invention may be encased in a more ductile metal including, for example, aluminum, lead, copper, steel, or alloys thereof. The present invention may be employed with any such penetrators as known in the art.

Figure 2:
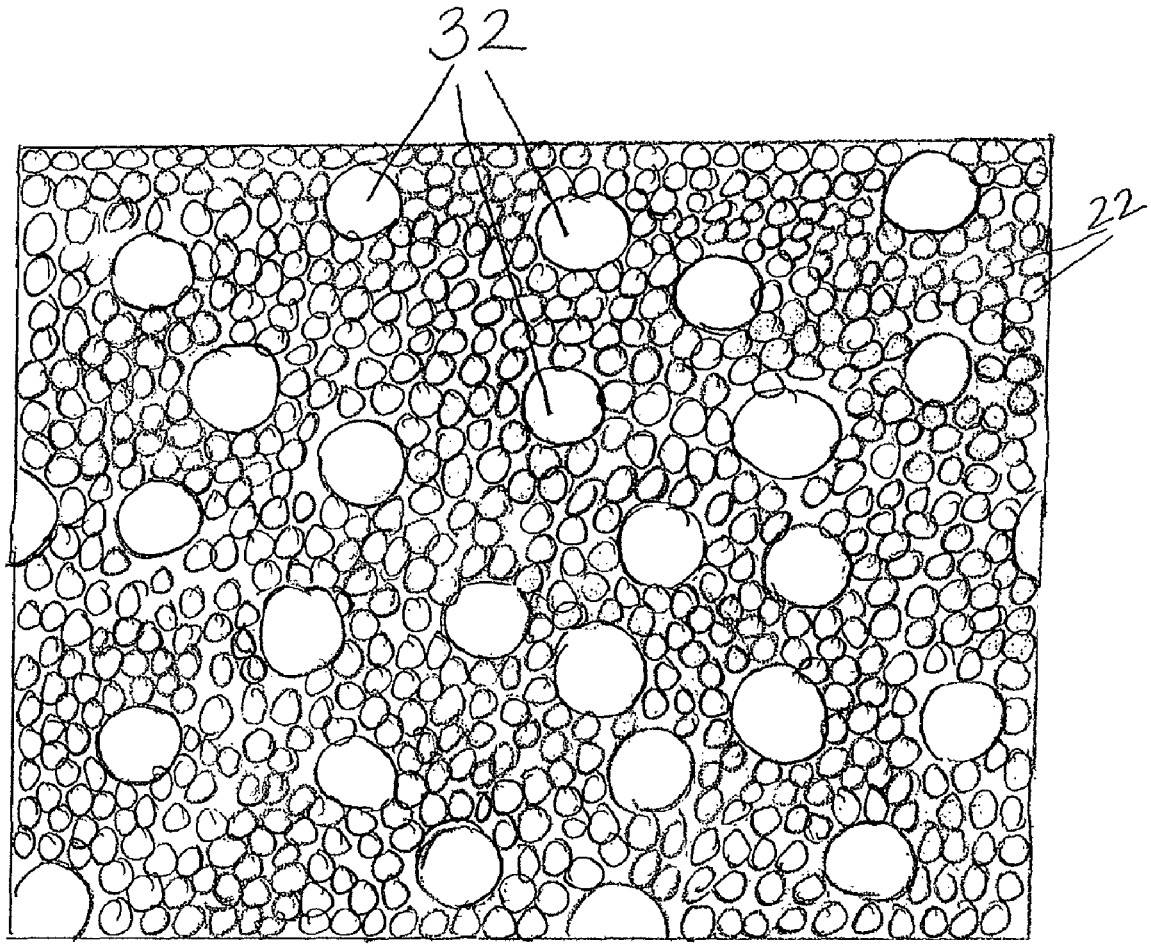
FIG. 2 illustrates a schematic view of a consolidated body of a metal nanoparticles phase and a metal carbide nanoparticles phase in accordance with an embodiment of the present invention.

Certain embodiments of the present invention relate to a kinetic energy penetrator comprising a consolidated body of a metal nanoparticles phase comprising metal nanoparticles and a metal carbide nanoparticles phase comprising metal carbide nanoparticles. As illustrated in FIG. 2, the metal phase comprises metal nanoparticles 22, and the metal carbide phase comprises metal carbide nanoparticles 32. Although the phases contain different nanoparticulate components, the metal phase and the metal carbide phase are consolidated, that is, joined together into a whole that makes up the kinetic energy penetrator of the present invention.

As used herein, the term "nanoparticles" refers to particles having an average particle size of substantially less than 1,000 nanometers (1 micron). As would be recognized by one skilled in the art, the term "average particle size" reflects a mean or average size over a statistical distribution of particle sizes. Particle size may be measured by any method and using any instrument commonly known in the art.

In certain embodiments, the metal nanoparticles of the metal phase have an average particle size of 500 nanometers or less. In other embodiments, the metal nanoparticles have an average particle size of 250 nanometers or less, such as 150 nanometers or less.

In certain embodiments, the metal carbide nanoparticles of the metal carbide phase have an average particle size of 500 nanometers or less. In other embodiments, the metal carbide nanoparticles have an average particle size of 250 nanometers or less, such as 150 nanometers or less.

In still other embodiments, both the metal nanoparticles of the metal phase and the metal carbide nanoparticles of the metal carbide phase have an average particle size of 500 nanometers or less, such as 250 nanometers or less, such as 150 nanometers or less within the kinetic energy penetrator of the present invention.

In certain embodiments, the metal nanoparticles of the metal phase comprise, but are not limited to, tungsten, uranium, tantalum, hafnium, rhenium, and the like. In certain embodiments, a combination of metals including any of the aforementioned metals may be used, for example, as a metal alloy. The choice of particular metals, as well as the concentrations of metals, will depend on the particular desired properties of the kinetic energy penetrator, including, for example, density. In certain embodiments, the metal nanoparticles comprise tungsten.

In certain embodiments, the metal carbide nanoparticles of the metal carbide phase comprise, but are not limited to, tungsten carbide, tantalum carbide, iron carbide, niobium carbide, and combinations thereof. In certain embodiments, a combination of metal carbides, including those described above, may be used. The choice of particular metal carbides, as well as the concentrations, will depend on the particular desired properties of the kinetic energy penetrator, including, for example, density. In certain embodiments, the metal carbide nanoparticles comprise tungsten carbide.

In certain embodiments of the present invention, the metal carbide nanoparticles prevent particle growth of the metal nanoparticles. As used herein, "prevent particle growth" refers to precluding and/or inhibiting an increase in particle size of the individual metal nanoparticles. It is believed that the metal carbide nanoparticles form on the boundaries of the individual metal nanoparticles and prevent the overall particle growth mechanism of the individual metal nanoparticles, although the inventors do not wish to be bound by any particular theory.

In certain embodiments, the tungsten carbide nanoparticles prevent particle growth of the tungsten nanoparticles, that is, the tungsten carbide nanoparticles preclude and/or inhibit an increase in particle size of the individual tungsten nanoparticles such that the tungsten nanoparticles remain nanoparticulate in size.

The ability to maintain the metal particles, such as tungsten, in nanometer particle sizes is believed to provide material properties critical to the performance of a kinetic energy penetrator. For example, the presence of nanoparticles can result in high strain rate failure, which results in adiabatic shearing. Adiabatic shearing promotes a self-sharpening mechanism in the penetrator during its short lived, high strain rate penetration in armor, providing a longer penetration time than would a material that does not experience this mechanism. By maintaining the nanometer-scale tungsten particles, it is believed that the adiabatic shearing mechanism dominates the high strain rate failure event, providing penetration results that are comparable to a similar density of depleted uranium at more typical that are often larger than nanoparticle size, although the inventors do not wish to be bound by any particular theory.

The amounts of the metal nanoparticles in the metal phase and the metal carbide nanoparticles in the metal carbide phase in the kinetic energy penetrator of the present invention may vary depending on the desired properties of the penetrator, for example, density, impact velocity, adiabatic shear, etc. In certain embodiments, the metal nanoparticles are present from 40 weight percent to 95 weight percent, such as from 60 weight percent to 90 weight percent, based on the total combined weight of the metal nanoparticles and the metal carbide nanoparticles. In other embodiments, the metal carbide nanoparticles are present from 5 weight percent to 60 weight percent, such as from 20 weight percent to 50 weight percent, based on the total combined weight of the metal nanoparticles and the metal carbide nanoparticles. In yet other embodiments, the metal nanoparticles are present at 70 weight percent and the metal carbide nanoparticles are present at 30 weight percent, based on the total combined weight of the metal nanoparticles and the metal carbide nanoparticles.

In certain embodiments, the metal carbide nanoparticles of the kinetic energy penetrator further comprise a binder matrix. The metal carbide nanoparticles may be cemented in a substantially continuous phase of material (commonly known as a "binder matrix") present for the purpose of embedding/cementing the nanoparticles together. Cementing typically occurs through a process known as "liquid phase sintering" wherein the nanoparticles are fused into a solid matrix of the binder, typically by heating the materials at high temperatures, such as above the melting point of the binder material.

The binder matrix may be any material commonly known in the art. In certain embodiments, the binder matrix comprises cobalt, nickel, iron, copper, and combinations thereof. In still other embodiments, a combination of binder matrix materials including any of the binder matrix materials described above may be used. The choice of particular binder matrix or combinations thereof, as well as concentrations, will depend on the particular desired properties of the kinetic energy penetrator, including, for example, density of the kinetic energy penetrator, as well as the desired particle size of the material and/or metal compound. In certain embodiments, the binder matrix comprises cobalt.

In certain embodiments, if a binder matrix is present, the binder matrix may be present at 15 weight percent or less, such as 10 weight percent or less, such as 5 weight percent or less, based on the total weight of the metal carbide nanoparticles.

In certain embodiments of the present invention, the metal carbide nanoparticles are substantially free of a binder matrix. As used herein, "substantially free of a binder matrix" means that the binder matrix is present at a low amount, for example, 2 or 3 weight percent or less. In other embodiments, the metal carbide nanoparticles are free of a binder matrix, that is, no binder matrix is present beyond that which may possibly be present merely as an incidental contamination.

While not wishing to be bound by any particular theory or mechanism, it is believed that the binder matrix present in the kinetic energy penetrators of the present invention, if any is present, is not acting as a binder matrix as that term is commonly known in the art, for example, as a cementing material as described above for the metal and/or metal compound. It is believed that the binder matrix may instead be characterized as acting as a catalyst. For example, as discussed above, in certain embodiments, the metal nanoparticles comprise tungsten and the metal carbide nanoparticles comprise tungsten carbide. In certain embodiments, a binder matrix is also present, for example, cobalt. While not wishing to be bound by any particular theory or mechanism, it is believed that the cobalt provides a location for the carbon to diffuse from the tungsten carbide nanoparticles to the tungsten nanoparticles.

In certain embodiments, the kinetic energy penetrators of the present invention have a high-density so as to provide certain desirable properties including, for example, to bring the highest kinetic energy to the target as well as increased depth of penetration once the penetrator impacts a target. In certain embodiments, penetrators of the present invention have a density of at least 17.0 grams/cm$^3$. In other embodiments, density may be at least 18.0 grams/cm$^3$.

In certain embodiments, the present invention is directed to a method for making a kinetic energy penetrator comprising: providing a blend of metal nanoparticles and metal carbide nanoparticles; consolidating the blend of the metal nanoparticles and the metal carbide nanoparticles to provide a consolidated body of a metal nanoparticles phase and a metal carbide nanoparticles phase; and recovering a shaped penetrator from the consolidated body of the metal nanoparticles phase and the metal carbide nanoparticles phase. The consolidating step may comprise compacting the blend of the metal nanoparticles and the metal carbide nanoparticles to provide a formed blend in a shape of a penetrator; heating the formed blend to form a metal nanoparticles phase and a metal carbide nanoparticles phase; applying pressure to the formed blend to provide a consolidated body of the metal nanoparticles phase and the metal carbide nanoparticles phase; and cooling the consolidated body. In certain embodiments, the method further comprises machining the shaped penetrator.

In certain embodiments of the methods of the present invention, the formed blend is consolidated by heating at a temperature below the temperature at which the metal nanoparticles melt. In other words, the blend of metal nanoparticles and metal carbide nanoparticles are heated at a temperature below the melting point of the metal nanoparticles present in the blend. In other embodiments, the formed blend is heated at a temperature below the temperature at which the metal carbide nanoparticles melt. In yet other embodiments, the formed blend is heated at a temperature below the temperature at which both the metal particles and the metal carbide particles melt.

As described above, the blend of powders is pressed, heated and subjected to pressure. Typically, the level of heating is not sufficient to melt or perform liquid phase sintering of either of the metal nanoparticles or the metal carbide nanoparticles constituents. Rather, in certain embodiments, the level of heating achieves an intermediate temperature that is below the melting point of either of the metal nanoparticles or the metal carbide nanoparticles. In other embodiments, the intermediate temperature is below the melting point of both the metal nanoparticles and the metal carbide nanoparticles. In certain embodiments, as discussed above, the metal nanoparticles and the metal carbide nanoparticles are phases, and these phases are consolidated, joined together, into a whole.

As discussed above, in certain embodiments, the metal nanoparticles and the metal carbide nanoparticles may be combined as a blend, such as by ball milling for a period of time, for example, for approximately two (2) hours. Any mill media may be used in the methods of the present invention including any of those mill medias commonly known in the art. In certain embodiments, a fine mill media, such as for example, a tungsten-carbide media, may be used. The media may be subsequently removed from the blend, and if a liquid material was present, the blend may be dried by any appropriate method, such as by applying heat. In certain embodiments, drying is accomplished, for example, by applying a low temperature to the blend. Any appropriate temperature may be used. In certain embodiments, the temperature is less than 100° C.

In certain embodiments, a liquid material may be combined with the blend of metal nanoparticles and metal carbide nanoparticles. Non-limiting examples of liquid materials suitable for use in the methods of the present invention include, for example, organic solvents, such as alkanes, alkenes, such as lacolene, alcohol, water, and combinations thereof. The particular liquid material, as well as the amount used in the method, may vary depending on a variety of factors including, for example, evaporation rate of the liquid material; the amount of nanoparticles present; milling time and temperature; type of milling media; processing parameters, etc. In certain embodiments, the liquid material is an organic solvent. The liquid material may be present at an amount sufficient to adequately wet out the nanoparticles. In those embodiments where the liquid material is present, the blend is dried for a period of time prior to the consolidating step. The drying time may vary provided it is sufficient to evaporate the liquid material from the blend.

In certain embodiments, compacting includes hand-packing the dried blend in a cold isostatic press ("CIP") balloon to form a cylindrical mold. The CIP balloon may be evacuated of air for any appropriate period of time, such as for approximately one (1) hour. In other embodiments, this balloon may be further nested in another CIP balloon which may also be evacuated of any air and sealed. In certain embodiments, the wrapped and molded blend may then be placed in a CIP balloon, and a pressure may be applied through the press. Any appropriate pressure may be used. In certain embodiments, a pressure of approximately 45,000 psi (pounds per square inch) may be applied and held for an appropriate period of time, for example, for approximately one (1) minute.

The resulting green compact may then be removed from the balloons and subjected to rapid omni-directional compaction ("ROC"), wherein the piece may be wrapped in alumina paper and graphoil, and placed in a crucible surrounded on all sides by glass pellets. In certain embodiments, the crucible containing the formed blend is then heated at any appropriate temperature by placing it into a furnace to form a metal nanoparticles phase and a metal carbide nanoparticles phase. In certain embodiments, a temperature of approximately 1400° C. may be applied for any appropriate period of time, such as approximately two (2) hours. In other embodiments, an appropriate pressure, for example, approximately 120,000 psi, is next applied to the formed blend to provide a consolidated body of the metal nanoparticles phase and the metal carbide nanoparticles phase. In certain embodiments, the fixated blend may then be cooled and removed from the glass before forwarding for machining.

The following examples are intended to illustrate various aspects of the invention and are not intended to limit the scope of the invention. Unless otherwise indicated, all percentages are by weight.

Examples

The following materials were used to prepare a kinetic energy penetrator: (a) nano-crystalline tungsten powder approximately 50 nanometers crystallite size; and (b) nano-crystalline tungsten carbide/cobalt powder approximately 150 nanometers crystallite size comprising tungsten carbide with 12% cobalt based on the total weight of the tungsten carbide/cobalt powder.

Materials (a) and (b) were combined in a weight proportion of 70% material (a) and 30% material (b). Lacolene (naphtha) organic solvent was added to materials (a) and (b) in an amount sufficient to adequately wet the materials (a) and (b). The combined materials were blended by ball milling for approximately two (2) hours using a fine tungsten-carbide media as the milling media. At the end of the two (2) hour time period, the milling media was removed from the blended particulate components of nanoparticles using a mechanical sieve. The blended nanoparticles were then dried at a temperature of less than approximately 100° C. for approximately 4 hours to remove the lacolene solvent via evaporation.

After drying, the blended nanoparticles were hand-packed in a cold isostatic press (CIP) balloon to a cylindrical mold. The CIP balloon was evacuated of air for approximately one (1) hour, then sealed to hold the vacuum. The CIP balloon was further nested inside a second CIP balloon, which was also evacuated of air for approximately one (1) hour and sealed. A pressure of approximately 45,000 psi was then applied through the CIP balloon and held for approximately one (1) minute.

The resulting green compact was removed from the CIP balloons. Then, the green compact was subjected to rapid omni-directional compaction (ROC) as follows. The green compact was wrapped in alumina paper and graphoil, then placed in a crucible surrounded on all sides by glass pellets. The crucible was placed in a furnace and heated to approximately 1,400° C. for a duration of approximately two (2) hours. Following the heating process, the green compact and molten glass was subject to a pressure of approximately 120,000 psi for approximately 30 to 60 seconds and subsequently allowed to cool. The glass was removed, and the sample was machined to form the shape of a kinetic energy penetrator similar to that shown in FIG. 1 having a diameter of approximately 16 mm, a length of approximately 98 mm, and a hemispherical head.

Figure 3:
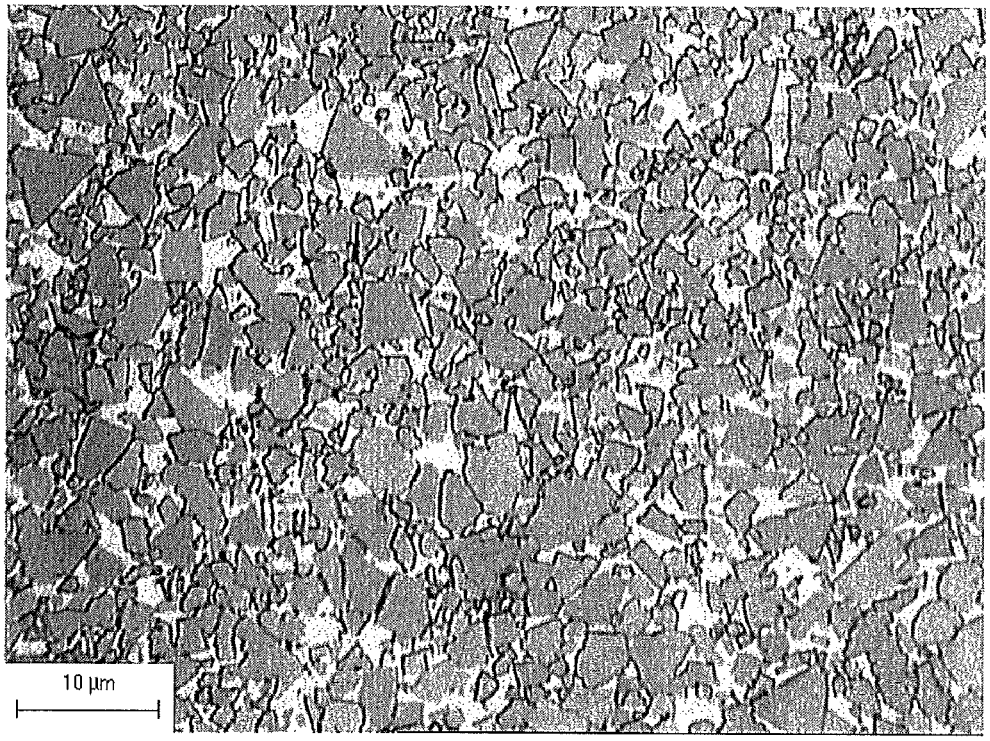
FIG. 3 is an optical microscope photograph of a conventional tungsten carbide-cobalt cemented carbide material containing 12 weight percent cobalt.

FIG. 3 illustrates an optical micrograph photograph showing the micro-structure of specimens taken from a typical tungsten carbide-cobalt containing 12% cobalt. As shown in FIG. 3, the average particle size of typical tungsten carbide particles range from approximately 5 to 10 μm (micrometers) which is equivalent to 5,000 to 10,000 nanometers in size.

Figure 4:
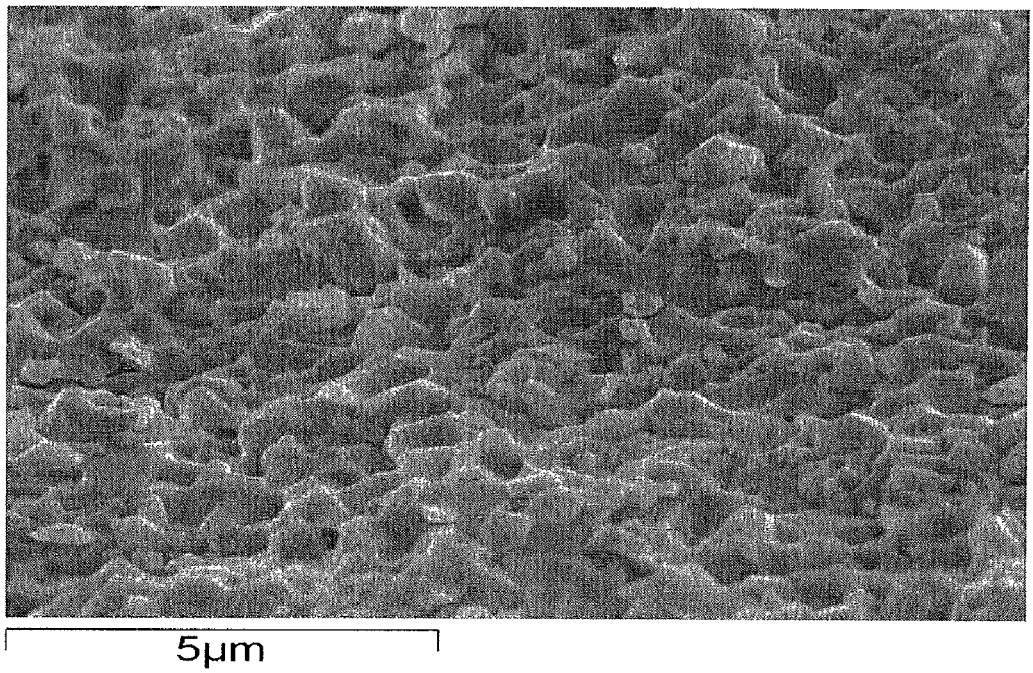
FIG. 4 is an electron micrograph of a consolidated body of a tungsten nanoparticles phase and a tungsten carbide nanoparticles phase comprising 30 weight percent of tungsten carbide nanoparticles with cobalt binder in accordance with an embodiment of the present invention.

FIG. 4 illustrates an electron micrograph illustrating a fracture surface of a consolidated body of tungsten nanoparticles phase with 30% tungsten carbide-cobalt nanoparticulate phase containing 12% cobalt, as an embodiment of the present invention. As shown in FIG. 4, the average particle size of tungsten carbide particles in an embodiment of the present invention are less than 1,000 nanometers.

Figure 5:
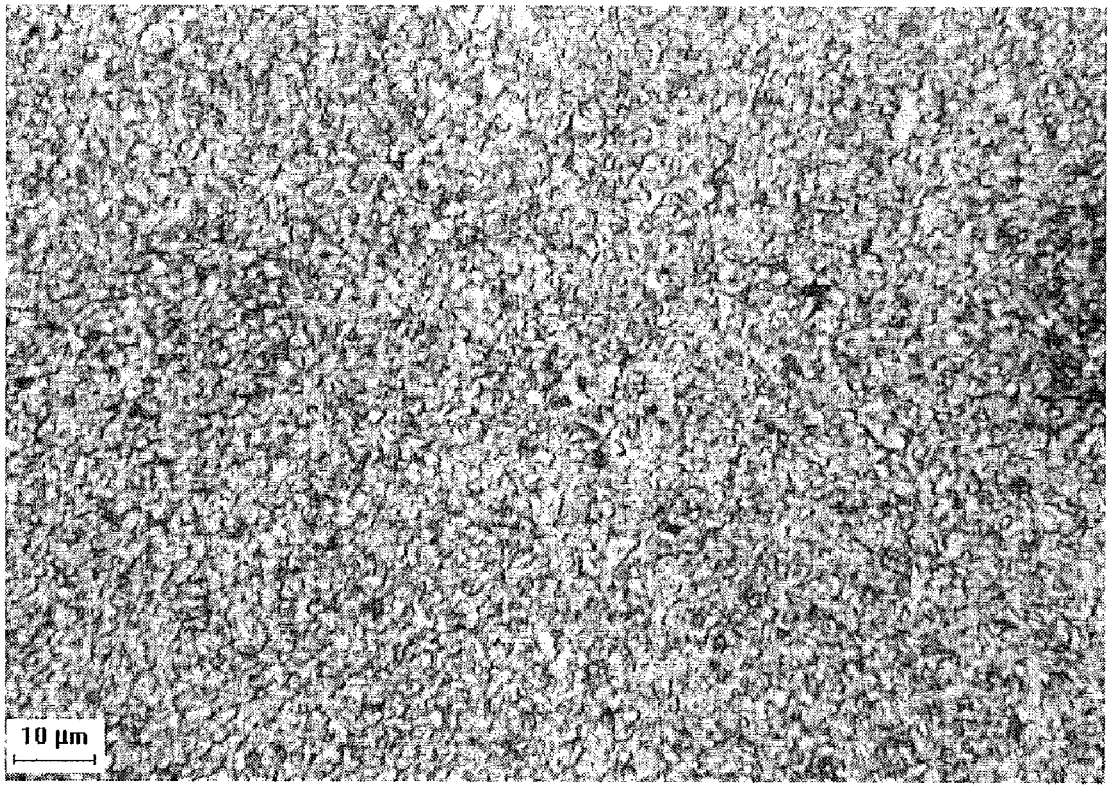
FIG. 5 is an optical microscope photograph of a consolidated body of a tungsten nanoparticles phase and a tungsten carbide nanoparticles phase containing 70 weight percent tungsten nanoparticles and 30 weight percent tungsten carbide nanoparticles with 12 weight percent cobalt in accordance with an embodiment of the present invention.

FIG. 5 illustrates an optical micrograph photograph illustrating 70% tungsten and 30% tungsten carbide-cobalt containing 12% cobalt in an embodiment of the present invention. As shown in FIG. 5, the average particle size of the two particulate phases of nanoparticles, tungsten and tungsten-carbide, is less than 1,000 nanometers.

It will be appreciated by those skilled in the art that changes could be made to the embodiments described above without departing from the broad inventive concept thereof. Whereas, particular embodiments of this invention have been described above for purposes of illustration, it will be evident to those skilled in the art that numerous variations of the details of the present invention may be made without departing from the invention as defined in the appended claims.

What is claimed is:

1. A kinetic energy penetrator comprising a consolidated body of a metal phase comprising metal nanoparticles and a metal carbide phase comprising metal carbide nanoparticles, wherein the metal nanoparticles comprise a metal selected from the group consisting of tungsten, uranium, tantalum, hafnium, rhenium, and combinations thereof, and wherein the metal carbide nanoparticles comprise a metal carbide selected from the group consisting of tungsten carbide, tantalum carbide, iron carbide, niobium carbide, and combinations thereof, and wherein the metal carbide nanoparticles prevent particle growth of the metal nanoparticles.

2. The kinetic energy penetrator of claim 1, wherein the metal carbide nanoparticles are cemented together in a binder matrix.

3. The kinetic energy penetrator of claim 2, wherein the binder matrix comprises cobalt, nickel, iron, copper, and combinations thereof.

4. The kinetic energy penetrator of claim 2, wherein the binder matrix is present in an amount up to 15 weight percent, based on the weight of the metal carbide nanoparticles.

5. The kinetic energy penetrator of claim 2, wherein the metal carbide nanoparticles are substantially free of a binder matrix.

6. The kinetic energy penetrator of claim 1, wherein the metal nanoparticles comprise tungsten and the metal carbide nanoparticles comprise tungsten carbide.

7. The kinetic energy penetrator of claim 1, wherein the metal nanoparticles have an average particle size of 500 nanometers or less.

8. The kinetic energy penetrator of claim 7, wherein the metal nanoparticles have an average particle size of 250 nanometers or less.

9. The kinetic energy penetrator of claim 1, wherein the metal carbide nanoparticles have an average particle size of 500 nanometers or less.

10. The kinetic energy penetrator of claim 9, wherein the metal carbide nanoparticles have an average particle size of 250 nanometers or less.

11. The kinetic energy penetrator of claim 1, wherein the metal nanoparticles are present from 40 weight percent to 95 weight percent, based on the total combined weight of the metal nanoparticles and the metal carbide nanoparticles.

12. The kinetic energy penetrator of claim 1, wherein the metal carbide nanoparticles are present from 5 weight percent to 60 weight percent, based on the total combined weight of the metal nanoparticles and the metal carbide nanoparticles.

13. The kinetic energy penetrator of claim 1, wherein the penetrator has a density of at least 17.0 grams/cm3.

* * * * *

UNITED STATES PATENT AND TRADEMARK OFFICE

CERTIFICATE OF CORRECTION

PATENT NO. : 8,171,851 B2
APPLICATION NO. : 12/416564
DATED : May 8, 2012
INVENTOR(S) : David Richard Siddle et al.

It is certified that error appears in the above-identified patent and that said Letters Patent is hereby corrected as shown below:

IN THE SPECIFICATION

In Columns 7 & 8, Lines 67 & 1, delete “fixated” and insert -- formed --, therefor.

Signed and Sealed this
Thirtieth Day of April, 2013

Teresa Stanek Rea
*Acting Director of the United States Patent and Trademark Office*